US006655650B2

(12) United States Patent
Ward

(10) Patent No.: US 6,655,650 B2
(45) Date of Patent: Dec. 2, 2003

(54) CONCRETE FORMING PANEL WITH FLEXIBLE BARRIER

(75) Inventor: Philip T. Ward, Leawood, KS (US)

(73) Assignee: Western Forms, Inc., Kansas City, MO (US)

( * ) Notice: Subject to any disclaimer, the term of this patent is extended or adjusted under 35 U.S.C. 154(b) by 109 days.

(21) Appl. No.: 09/834,149

(22) Filed: Apr. 12, 2001

(65) Prior Publication Data

US 2002/0148195 A1 Oct. 17, 2002

(51) Int. Cl.[7] ..... E04G 9/00

(52) U.S. Cl. ..... 249/189; 249/47; 249/18; 249/194; 249/210; 249/191; 52/742.1; 52/742.14

(58) Field of Search ..... 249/47, 38, 18, 249/193, 194, 196, 33, 207, 210, 189, 191, 192; 52/742.1, 742.13, 742.14, 214

(56) References Cited

U.S. PATENT DOCUMENTS

| | | | | |
|---|---|---|---|---|
| 4,405,112 A | * | 9/1983 | Doubleday et al. | 249/207 |
| 4,708,315 A | | 11/1987 | Carlson et al. | |
| 4,744,541 A | | 5/1988 | Carlson et al. | |

(List continued on next page.)

FOREIGN PATENT DOCUMENTS

| | | | | |
|---|---|---|---|---|
| JP | 5-86671 | * | 4/1993 | E04B/2/94 |
| JP | 6-288086 | * | 10/1994 | E04G/9/06 |

OTHER PUBLICATIONS

Western Forms, Inc. Catalog titled "World's Leading Innovator in Aluminum Forming Systems" copyright 1999, all pages.

Article titled "Good forming details: a critical element in architectural concrete" from "Concrete Construction" Magazine, Nov. 1972.

Hard copies of screens from the following Felton Brush Web site addresses: http://www.feltonauto.com/currentapps.htm.

Hard copies of screens from the following Felton Brush Web site addresses: http://www.feltonauto.com/current_cup-s.htm.

Hard copies of screens from the following Felton Brush Web site addresses: http://www.feltonauto.com/current_prndl.htm.

Brochure: The World's Leading Innovator in Aluminum Forming Systems (Western Forms, Inc, 1993) (1 page and 1 card enclosure in the back) (6 pages printed on front and back including cover).

Brochure: A New Generation in Aluminum Forming Systems (Western Forms, Inc. 1998) (6 pages printed on front and back including cover).

Brochure: Concrete Forming Accessories, 2nd ed. (Western Forms, Inc. [before 1999]) (49 printed pages not including front/back cover, divider tabs and printing on inside of covers).

*Primary Examiner*—Carl D. Friedman
*Assistant Examiner*—Chi Q. Nguyen
(74) *Attorney, Agent, or Firm*—Hovey Williams LLP

(57) ABSTRACT

A forming panel and method for using the same in construction of self-sustaining concrete wall structures is provided wherein a flexible barrier element is provided along a margin on the forming panel for impeding the flow of water and fine particles of a concrete mix pour past the barrier element. The margin may be along the perimeter edge of the forming panel or along an opening interior to the perimeter of the forming panel. When located near the perimeter, the flexible barrier element may be positioned in a slot extending parallel to the margin and located in the frame. When located near an interior opening, the barrier element may be provided on a reinforcing member positioned around the opening or on a door which shifts to improve access through the opening during placement of forming ties or the like. The forming panel may be coupled with adjacent forming members to provide a wall system, and two wall systems may be connected by forming ties to provide a channel for receipt of a concrete pour therebetween.

57 Claims, 4 Drawing Sheets

U.S. PATENT DOCUMENTS 4,957,272 A * 9/1990 Lee ..... 249/196
4,958,800 A 9/1990 Carlson
4,976,401 A 12/1990 Carlson
4,978,099 A 12/1990 Carlson
5,044,601 A * 9/1991 Miller ..... 249/194
5,058,855 A 10/1991 Ward
5,080,321 A 1/1992 Carlson
5,083,740 A * 1/1992 Sawyer et al. ..... 249/219.1
5,160,640 A * 11/1992 Badstieber ..... 249/189
5,174,909 A 12/1992 Ward
5,184,439 A 2/1993 Ward
5,288,051 A 2/1994 Ward
5,671,488 A * 9/1997 Greferath ..... 52/35
5,792,552 A * 8/1998 Langkamp et al. ..... 428/309.9
5,836,126 A * 11/1998 Harkenrider et al. ..... 52/410
5,965,053 A 10/1999 Carlson
5,975,482 A * 11/1999 Wu et al. ..... 249/18
5,979,138 A * 11/1999 Allen ..... 52/745.09
6,400,048 B1 * 6/2002 Nishimura et al. ..... 310/47
6,419,204 B1 * 7/2002 Flathau ..... 249/194
6,502,802 B2 * 1/2003 Jorn et al. ..... 249/194

* cited by examiner

CONCRETE FORMING PANEL WITH FLEXIBLE BARRIER

BACKGROUND OF THE INVENTION

1. Field of the Invention

The present invention broadly concerns a forming panel used in forming wall structures of hardenable concrete, whereby multiple panels may be placed in adjacency and in opposition for receiving and supporting the concrete pour therebetween. More particularly, it is concerned with a concrete forming panel which includes a flexible barrier positioned adjacent and preferably aligned with a margin on the forming panel such as a perimeter edge or on an interior edge to inhibit the flow of the concrete mix therepast.

2. Description of the Prior Art

The formation of building walls, foundations and other wall structures from poured concrete after curing is well known and the forms used for holding the concrete fall into two general categories. Forming walls may be made of site-built forms, typically of plywood, and are used only once before being discarded, or of reusable forming panels, typically of wood, steel or aluminum or combinations thereof, which panels may be fastened together and then removed from the hardened concrete wall for reuse. While these reusable forming panels are typically of a greater initial cost, their ability to be repeatedly used more than compensates for the initial expense.

The reusable forming panels typically have a face plate supported by a frame and are joined together in adjacency (essentially side-by-side or angled) to provide a form wall, and two form walls oppose one another to receive the concrete therebetween. Each forming panel may have a number of relieved areas along the side to receive tie bars for connecting the opposing form walls. Where the panels meet along their perimeters, small gaps are present, especially in the relieved areas not occupied by a tie bar. Moreover, the panels may have interior holes or openings which are penetrated interiorly of the perimeter of the forming panel by tie bars, rods or the like, and there are similar gaps between the tie bars and the surrounding forming panel. The concrete is mixed with water to make it flowable and ready to pour, the concrete mix typically including water, fine particles of mortar and sand, and aggregate such as gravel. In the gaps along the perimeter of the forming panels and where there are openings on the interior of the forming panel, water and fine particles of sand and mortar of the wet concrete will typically migrate from the concrete pour during curing. As a result, the appearance of the cured and hardened concrete opposite these gaps will be discolored, and will typically have significant raised ridges and be pitted rather than smooth as appears along the face of the forming panel. The large ridges and the pitted area along the face may affect not only the appearance but also the performance of the concrete wall over time.

SUMMARY OF THE INVENTION

These problems are significantly ameliorated by the concrete forming panel provided with a flexible barrier in accordance with the present invention. By the provision of a flexible barrier along and proximate to one or more margins in the forming panel which engage flowable concrete during curing, such as the face plate and frame, a substantial reduction in the loss of fine mortar particles and water is achieved. This results in a finished wall surface with substantial reduction of discoloration and pitting, even in the relieved tie bar passage area or interior openings. The flexible barrier serves as a gasket which yields for variations in the size of the gaps as well as permitting tie bars and other forming accessories to abut and pass thereby, and stands up to rugged use environments. Moreover, when the panel has an opening within the perimeter of the face plate and rails of the frame, by providing an interior margin provided with such a barrier within the perimeter of the forming panel, the forming panel hereof substantially reduces the problem of large ridges and pitting where tie bars and other forming hardware must pass through openings in the frame inside of the perimeter. An additional benefit is reduced seepage of moisture into and through the hardened wall structure.

In greater detail, the forming panel with flexible barrier along one or more of its margins broadly includes a form configured to receive a pour of a flowable concrete mix in supporting relationship thereagainst, the forming panel in a face plate typically of aluminum and a frame also of aluminum or steel having at least one siderail. The frame typically includes parallel and spaced apart, opposed endrails, siderails in spaced relationship and extending parallel thereto, and crossbraces, end reinforcements and gusset plates. The rails have exposed edges and face plate edges, with elongated grooves provided in the rails (both endrails and siderails) on the exterior side thereof. Flexible barriers acting as gaskets, preferably of filaments such as brush strips, are received in the grooves to impede the migration of water and fine particles of the concrete mix therepast as the barriers engage opposing parts of the forming panel or adjacent forming panels. The brush fibers of the brush strips are preferably oriented at an angle toward the concrete-receiving surface of the face plate and extend beyond the outer surface of the frame, whereby when the barrier is engaged by another component of the forming panel, a tie bar, another forming panel or an opposing barrier, the brush fibers project toward the concrete mix in the pour and the face plate rather than away to minimize the amount of water and fine mortar and sand particles of the mix carried into the gap between forms. Alternately, or in addition to the flexible barrier positioned near the perimeter margin of the forming panel, openings within the face plate may have flexible barriers mounted in proximity. The openings within the face plate may be substantially covered by a shiftable door which may be hinged, so that when there is no need to pass a tie bar therethrough, the door may be sealed. On the other hand, opening the door greatly facilitates placement and coupling of a tie bar to the forming panel, and closing of the door still permits a tie bar to pass thereby. The flexible barrier may be provided on either the door or a reinforcing enclosure around the opening, or both. The door is preferably hingably mounted to the reinforcing enclosure and a closure member provided to hold the door closed. A narrow gap may be provided between the door and the face plate when the door is in a closed position, to thereby permit the tie bar to pass therethrough when the door is closed, the barrier element helping to seal the gap.

As a result, forms are provided which substantially reduce the amount of discoloration and pitting in the finished wall surface, minimize the formation of ridges of material migrating into the gaps between forms, and provide an improved finished concrete surface while remaining rugged in use. These and other advantages will be appreciated by those skilled in the art with reference to the drawings and description which follow.

DESCRIPTION OF THE PREFERRED EMBODIMENT

Figure 4:
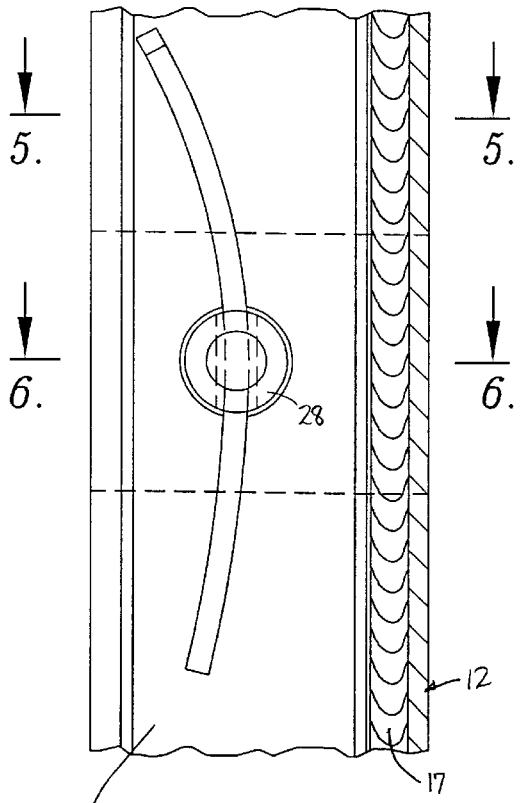
FIG. 4 is an enlarged, fragmentary vertical sectional view through a portion of the face plate and showing a coupler pin and wedge for holding together two forming panels in side by side relationship and with a tie bar shown in broken lines.
Figure 5:
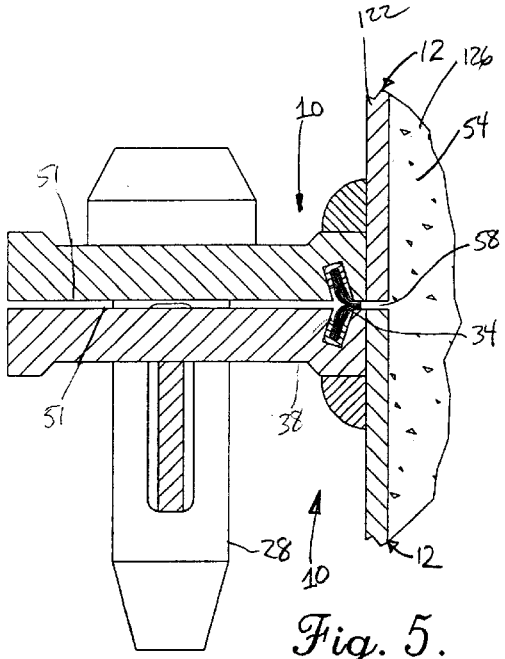
FIG. 5 is an enlarged, fragmentary cross-sectional view taken through line 5—5 of FIG. 4, showing the orientation of two opposed flexible barrier elements of adjacent forming panels extending into the gap therebetween.
Figure 6:
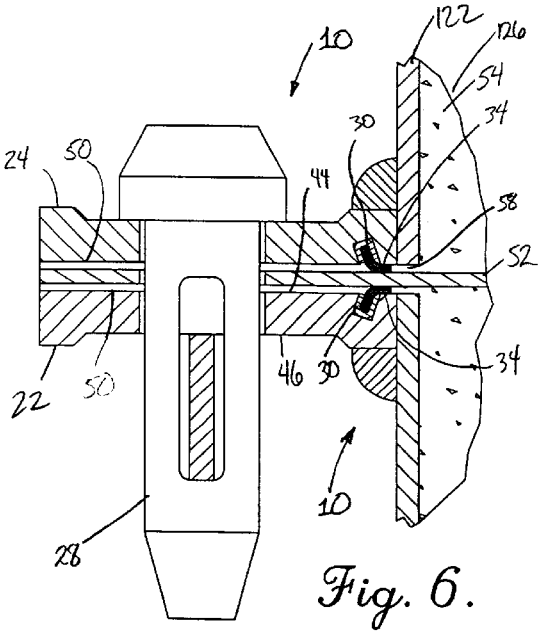
FIG. 6 is an enlarged, fragmentary cross-sectional view taken through line 6—6 of FIG. 4, showing the orientation of the two opposed flexible barrier elements when compressed by a tie bar received in the relieved area and passing through the gap.

Referring now to the drawing, a concrete forming panel 10 in accordance with the present invention broadly includes a face plate 12 typically of aluminum and a frame 14 mounted along the perimeter 15 of the forming panel 10, also preferably primarily of aluminum by welds 17. As used herein, "aluminum" refers to aluminum alloys, such as, for example, ASTM 6061 T-6 alloy, and the face plate, and a typical thickness of aluminum sheeting used as a face plate 12 would be about 0.125 inch. The frame 14 preferably includes a pair of elongated endrails 16 and 18 and a pair of opposed siderails 20 and 22, which in the illustrated embodiment the siderails are shown parallel to each other and perpendicular to the endrails, although it may be appreciated that it is possible for the forming panel to be in various geometries and have arcuate edges. A typical endrail or siderail of aluminum has a thickness of about ⅜ inch. The frame may include cross-braces 24, and end braces, gusset plates at the corners, and steel bushing plates or reinforcements to reinforce holes 26 spaced along the siderails 20 and 22 which receive therethrough coupler pins 28 secured by wedges as shown in FIGS. 4, 5 and 6, with such steel reinforcing members positioned adjacent the holes 26 for wear resistance. The face plate 12 lies in a plane and is shown flat and smooth, although textured surface face plates 12 may be used as well.

Figure 2:
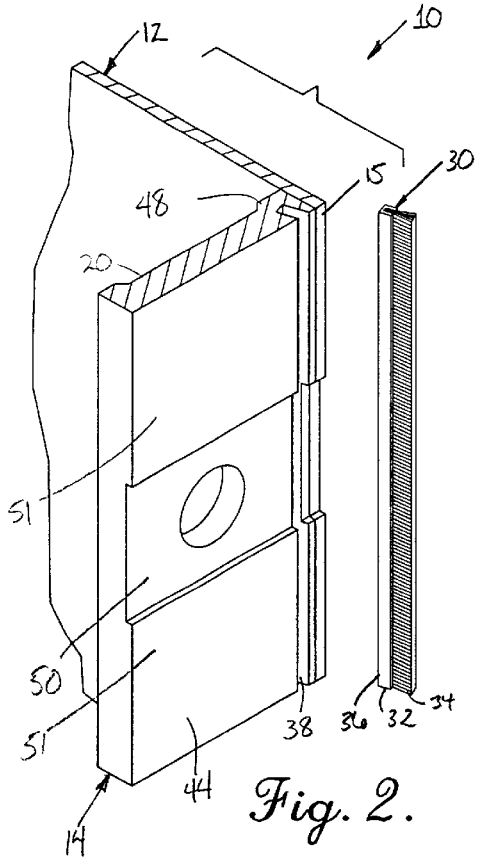
FIG. 2 is an enlarged, fragmentary perspective view showing a siderail and face plate in section and a relieved area for the passage of a tie bar, with the flexible barrier shown in an exploded view.
Figure 3:
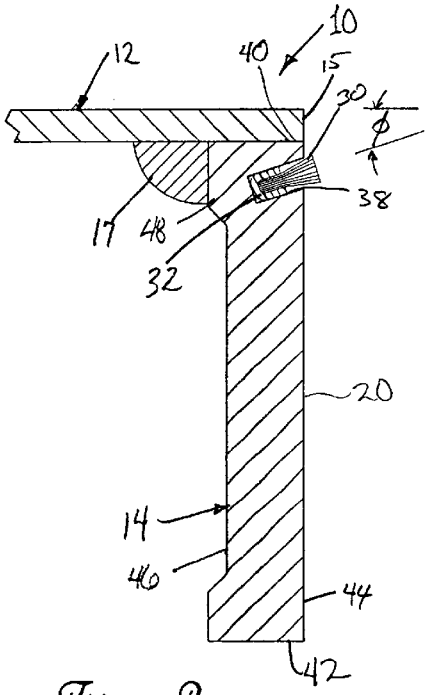
FIG. 3 is an enlarged fragmentary horizontal sectional view through a sidewall and the face plate showing the orientation of the tips of the fibers of the flexible barrier oriented at an acute angle to the plane in which the face plate lies.

A barrier element 30 of flexible material such as rubber or more preferably brush strips 32 of nylon fibers or bristles 34 secured by metal retaining clips 36 is received in longitudinally extending slots 38 in the siderails 20 and 22 and the endrails 16 and 18. The slots 38 are located more proximate the face plate edge 40 of the siderails and endrails than the back side exposed edge 42 of the siderails and endrails. The siderails and endrails each have an outer surface 44 and an inner surface 46, the slots 38 being in communication with the outer surface 44 as shown in FIGS. 2 and 3. The slots 38 are most preferably provided at an acute angle $\phi$ relative to the face plate 12 so that the bristles 34 extend forwardly toward the face plate edge 40 of the siderails and endrails. The bristles 34 are also of a sufficient length relative to the depth of the slots 38 that they project beyond the outer surface 44. The slots 38 are preferably positioned in a thickened region 48 of the siderails and endrails as shown in FIG. 3 in order to avoid weakening of the siderails and endrails.

Figure 7:
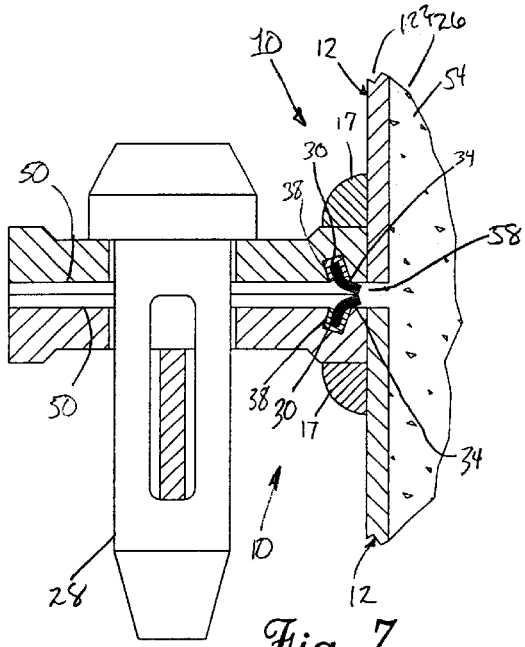
FIG. 7 is an enlarged, fragmentary cross-sectional view similar to FIG. 6, showing the relieved area adapted to receive the tie bar as in FIG. 6, but in the condition when a tie bar is not placed therethrough, with the flexible barrier elements engaging one another in the gap.
Figure 8:
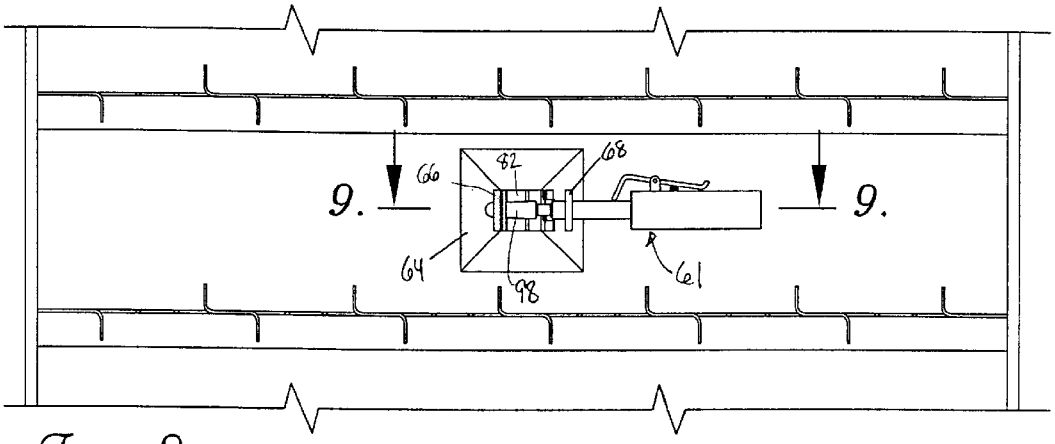
FIG. 8 is a rear elevational view of another aspect of the forming panel of FIG. 1, showing the portion of the forming panel which is provided with an opening in the face plate interior to the perimeter of the face plate and the side rails and end rails of the frame and having a reinforcing enclosure around the opening and a door for substantially closing the opening.

The siderails 20 and 22 are not of constant thickness along their longitudinal length, but rather their outer surface 44 is provided with longitudinally spaced, laterally extending relieved areas 50 adjacent unrelieved areas 51, the relieved areas 50 providing passages for tie bars 52 to be placed thereon and in the gaps between adjacent forming panels 10 as shown in FIGS. 6 and 7. The tie bars 52 are used to separate and hold at a predetermined distance an opposite forming wall of other forming members in order to provide a channel 126 therebetween for receipt of a pour of flowable concrete 54 therein. An adjacent relief 56 is also provided in the face plate 12. As may be seen in comparing FIG. 5 showing two adjacent forming panels 10 in side-by-side relationship in cross-section taken through the siderails 20 and 22 of adjacent forming panels 10 with FIG. 6 taken in cross-section through the siderails 20 and 22 and the tie bar 52, the depth of the slots 38 are slightly less in the vicinity of the relieved areas 50 so that the tips of the barrier element fibers are substantially linear thus equidistant in a direction perpendicular from the outer surface 44 at the unrelieved areas 51 and exposing slightly more of the barrier element fibers in the relieved areas 50 than the unrelieved areas. Because the slots 38 are oriented on an axis that is at an acute angle $\phi$ relative to the plane in which the face sheet 12 lies, the resulting forward angled orientation of the bristles 34 toward the face plate 12, the engagement of opposed flexible barriers 30 with a tie bar 52 or with the barrier element 30 of an adjacent forming panel 10 causes the bristles 34 to slightly bend in a forward direction as shown in FIGS. 5 and 6. This in turn enhances the performance of the barrier element 30 by providing both a greater density of concentration of the bristles 34 where they interengage and also extending them forwardly to reduce the region into which water and particles from the concrete pour may migrate and lessen the extent of any ridge which may be formed as the concrete flows in to the gap 58 between the adjacent forms 10. As shown in FIG. 7, the bristles 34 of the barrier elements 30 are particularly helpful where there is no tie bar 52 positioned in a relieved area 50, which would otherwise present an even wider opening between the adjacent forming panels 10. The barrier elements 30 are preferably mounted all around the forming panel 10 on each of the rails in an orientation parallel to and closely adjacent the perimeter of the face plate 12.

FIGS. 1 and 8–11 illustrate an alternate embodiment where, in addition or as an alternative to the flexible barrier element 30 provided in the frame 14 around the perimeter of the forming panel 10, an opening 60 is provided in the face plate 12 inside the frame 14 and thus interiorly of the perimeter. A closure and support element 61 is attached to the face plate 12 adjacent the opening, shown as a reinforcing enclosure 62 of aluminum which surrounds and thus reinforces the opening and is attached to the face plate 12 or the cross members by welding, fasteners or the like. The enclosure 62 includes a base 64 which mounts to the face plate 12 by welding or the like to support and reinforce the face plate 12 surrounding the opening 60 and two spaced-apart gates 66 and 68, each having a respective passage 70 and 72 therethrough. A reinforcing rod 74 of hard steel, such as ASTM 228-93 wire, is received in a groove 76 adjacent the passages 70 and 72 and the deformation of the aluminum alloy caused by drilling the passages serves to pinch or hold the rod 74 in place. The reinforcing rod 74 helps to resist wear on the gates 66 and 68 and prevent enlargement of the passages. The base 64 may include a slot 78 adjacent to and facing the opening for receipt of a flexible barrier element 30 therein. Again, the flexible barrier elements may be rubber or more preferably brush strips 32 of nylon bristles 34 held by metal clips.

Figure 9:
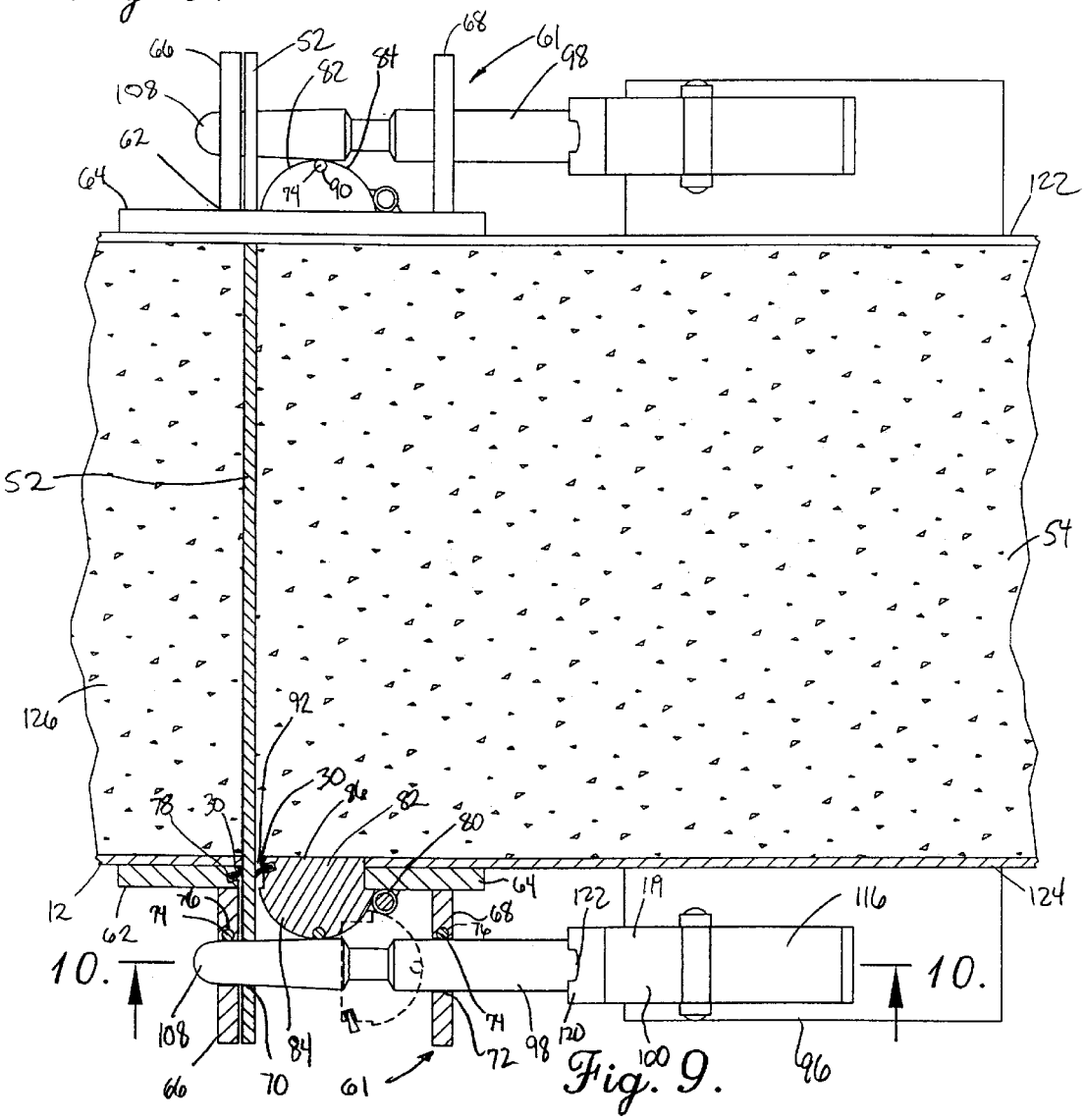
FIG. 9 is an enlarged, fragmentary cross-sectional view taken along line 9—9 of FIG. 8, showing two opposed forming panels of opposite forming walls positioned and connected by a tie bar for receiving flowable concrete in the channel therebetween, one of the panels being shown in plan, and the tie bar passing between the forming panels through the opening and a barrier element in both the enclosure and the door of the forming panels.

A hinge 80 is provided on the base 64 for pivotally mounting a door 82. As illustrated by FIG. 9, the door 82 may swing between a first position substantially but not completely closing the opening 60 and a second position which is open. The door 82 includes a head 84 and an insert 86 which fits within the opening 60. The head 84 presents a lip 88 which engages the base 64 and has a reinforcing rod 74 received in a groove 90 therein. The head 84 is sized to provide a slot 92 between the head 84 and the base 64 to permit passage of a tie bar 52.

Figure 10:
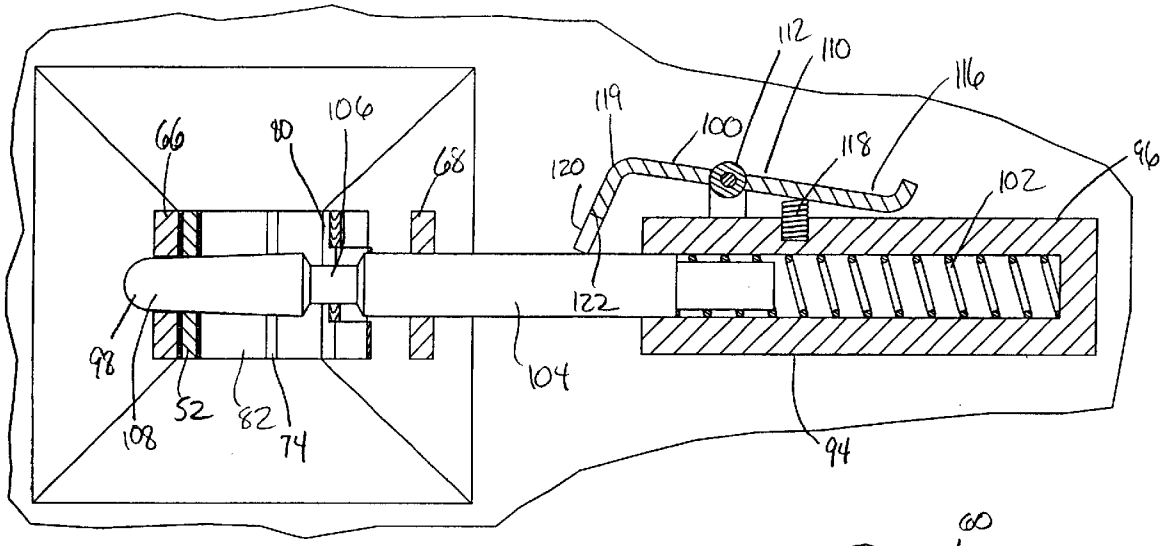
FIG. 10 is an enlarged, fragmentary elevational view in partial cross-section along line 10—10 of FIG. 9, showing the combination pin fastener and door retainer in a first position holding the door closed and passing through a hole in the tie bar.
Figure 11:
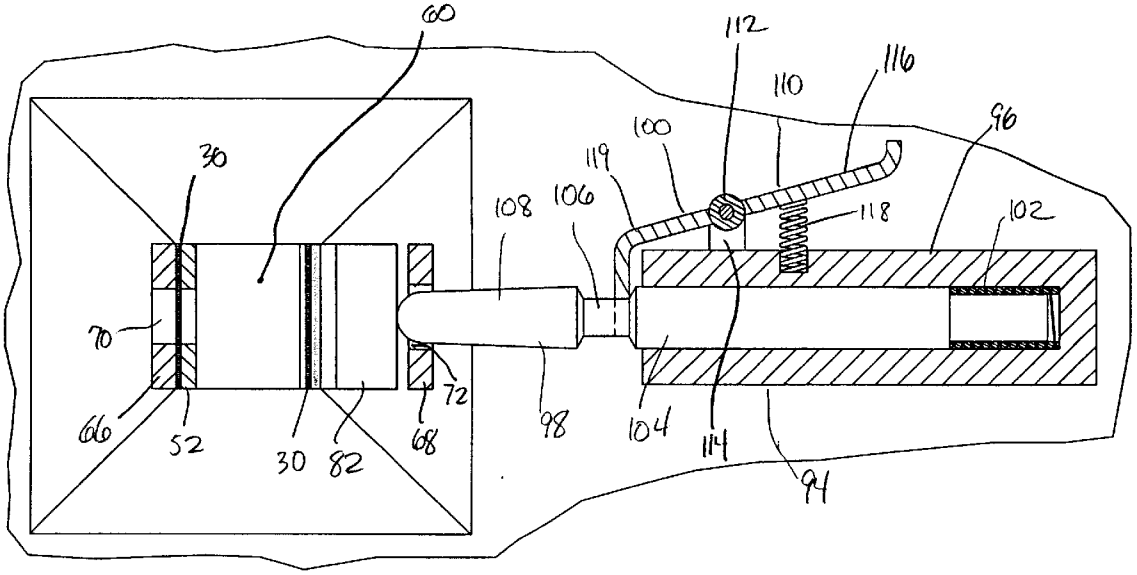
FIG. 11 is an enlarged, fragmentary elevational view in partial cross-section as in FIG. 10, but with the combination pin fastener and door retainer retracted and retained in a second position where the hinged door is open to facilitate insertion of the tie bar or removal of the forming panel.

The door 82 is held closed by closure mechanism 94. The closure mechanism 94 is mounted on arm welded to the face plate 12 or to a cross-brace 24 of frame 14. The closure mechanism 94 includes a housing 96, a pin 98 shiftably received in the housing 96, and a catch 100. As illustrated in FIGS. 10 and 11, the pin 98 is biased toward the gate 66 by a coil spring 102 received within the housing. The pin 98 includes a shank 104 slidable within the housing 96, a narrowed neck 106, and a nose 108 which is rounded at its tip. Both the nose 108 and the shank 104 have a greater diameter than the diameter of the neck 106. The catch 100 includes a bar 110 which is mounted by a hinge 112 for toggling on pivot mount 114. The bar 110 has a first end 116 which is engaged on its underside by a spring 118 extending from the housing 96 and a second end 119 which has a cradle 120 which includes an arcuate web 122 sized to receive the neck 106 but not the shank 104 therein. Thus, the spring 118 biases the cradle 120 toward the pin 98.

Figure 1:
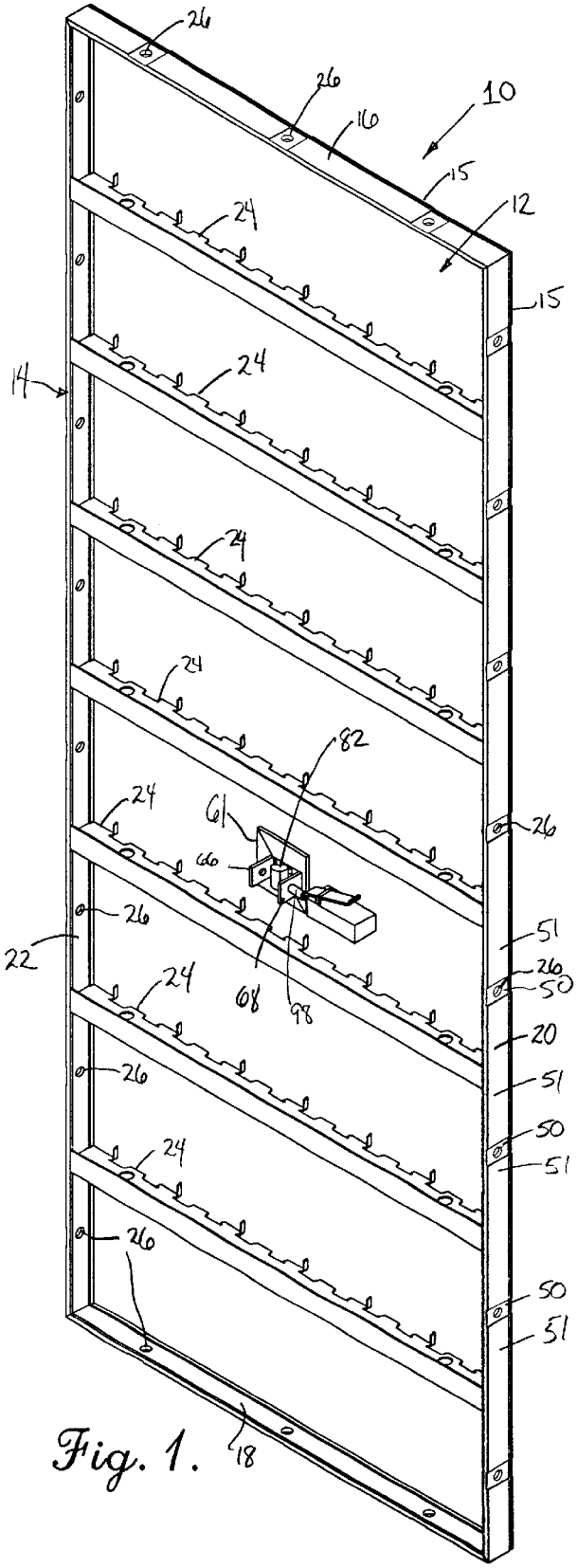
FIG. 1 is a rear perspective view of a concrete forming panel in accordance with the present invention, showing the face plate and the frame, with a flexible barrier extending around the siderails and endrails of the frame parallel to and adjacent the perimeter of the forming panel.

In use, the forming panel 10, shown individually in FIG. 1, is coupled to adjacent forming members, such as another forming panel 10 as shown in FIGS. 5, 6 and 7, to provide one forming wall 122, and another forming wall 124 is positioned opposite as shown in FIG. 9 so that a channel 126 for receiving flowable concrete 54 is therebetween. Tie bars 52 are placed in at least some of the relieved areas 50, though typically not all of them and extend through the channel to connect the forming walls 122 and 124 when connected to the forming panels by pins 28. Adjacent forming panels are connected by pins 28 held in place by wedges as shown in FIGS. 4, 5, 6 and 7, with these pins 28 passing through holes in the tie bars 52 to hold them in position. The tie bars extend across and through the channel 126 for connecting the opposing forming walls 122 and 124, whereby after the concrete 54 cures, the tie bars 52 remain embedded in the concrete wall structure formed thereby.

In addition, door 82 may swing open to facilitate positioning of a tie bar 52 through the opening 60 in opposing forming panels 10. The pin 98 is first retracted against the coil spring 102 and the catch is released whereby the web 122 of the cradle 120 rests around the neck 106 and against the shank 104 to hold the pin 98 in a retracted position. The tie bar 52 is then aligned to lie closely adjacent the gate 66, whereupon the door may be closed to substantially block the opening 60. With the door closed, the operator presses on the first end 116 of the catch 100 to release the spring loaded pin 98. The pin 98 then passes through the hole of the tie bar 52 and through the gate 66 to both hold the door 82 in the closed position and secure the forming panel 10 to the tie bar 52. Thereafter, dry concrete mixed with water may be poured into the channel 126, which after a suitable curing period, hardens. The barrier elements 30 substantially inhibit the flow of water and fine particles of mortar, sand and the like from the concrete 54 while it cures. The barrier elements 30 along the side rail and end rail edges oppose one another as shown in FIG. 5 to inhibit substantial flowing of material without inhibiting the performance or coupling ability of the forming panels. The bristles 34 yield when engaged by tie bars 52 or the frame 14 and being separate, resist tearing, while providing a substantial barrier to the flow of water and fine particles from the concrete. The flexible barrier elements are especially beneficial in resisting flow of water and fine particles both when a tie bar 52 is present in a relieved area 50 or, even more importantly, when a tie bar 52 is not used in a relieved area as shown in FIG. 7. When an opening 60 is provided in the forming panel interiorly of the perimeter provided by the frame, the door 82 is able to swing open to ease the placement of the tie bar. After the tie bar 52 is in place, the door may be closed to inhibit the flow of concrete or the water and fine particles thereof through the opening 60. The flexible barrier elements 30 in the base 64 and the door 82 further limit the migration of water and fine particles through the slot 92. The first end 116 of the bar 110 is depressed to release the cradle, whereupon the coil spring 102 pushes the pin 98 through the gate 66 so that the nose of the pin 98 rests against the head of the door 82 to hold the door in a closed position.

After the concrete 54 cures and hardens, the forming panels 10 may be readily removed for reuse by removing the wedges from the coupler pins 28 and pulling the coupler pins through the holes 26 in the rails. The pin 98 is retracted so that the cradle engages the neck of the pin 98 to permit opening of the door 82. This also disengages the pin 98 from the tie bar 52, permitting the forming panels 10 to be removed. The barrier elements 30 substantially limit the migration of water and fine particles from the concrete 54 as it hardens and thus inhibits the formation of substantial ridges opposite the gaps between forming panels. A smoother surface of the resulting wall with substantially less pitting results from the use of the barrier elements both around the perimeter edge of the forming panels 10 and at any interior openings.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. In a forming panel for use in construction of a self-sustaining concrete structure from a concrete mix containing flowable constituents which are capable of migrating from a concrete pour during curing of the mix, the improvement comprising:

a segment of the forming panel which defines a forward-facing, concrete-receiving surface located in a position oriented for receiving at least a part of the concrete pour thereagainst during curing of the mix and having a margin in disposition such that said flowable constituents in the concrete pour may migrate past the margin, said segment further defining a second surface adjacent said margin and leading rearwardly away from the concrete-receiving surface; and a flexible barrier element mounted in spaced relationship to said concrete-receiving surface on said second surface in proximal relationship to said margin and operable to impede migration of the constituents out of the pour past the barrier element until the concrete mix has cured, said segment of said forming panel including a face plate having said concrete-receiving surface thereon and said forming panel further including a frame upon which said face plate is mounted, and wherein said second surface is on said frame, wherein said margin is a perimeter margin of said face plate and said frame includes at least one elongated rail positioned adjacent said perimeter margin, and wherein said flexible barrier element is elongated and mounted on said rail in longitudinal alignment with the perimeter margin.

2. The forming panel of claim 1, wherein said frame includes a pair of side rails and a pair of end rails, and wherein said flexible barrier element is mounted on each of said side rails and said end rails proximate said perimeter margin.

3. The forming panel of claim 1, wherein said at least one rail includes a face plate edge adjacent said face plate and a back edge relatively remote from said face plate, and said rail further includes an outer surface having at least one relieved area extending between said face plate edge and said back edge and said perimeter margin in said face plate includes at least one recess aligned with said relieved area, said flexible barrier element being mounted on said outer surface to extend across said relieved area.

4. The forming panel of claim 3, wherein said at least one rail includes unrelieved areas adjacent said relieved area and wherein said an outer edge of said flexible barrier element in an uncompressed condition is substantially linear along said relieved area and said unrelieved areas.

5. The forming panel of claim 1, wherein said at least one rail includes an elongated slot substantially aligned with and spaced from said margin, and wherein said flexible barrier is received in said slot.

6. The forming panel of claim 5, wherein a portion of said face plate adjacent said margin is substantially in a plane and wherein said slot is oriented at an acute angle relative to said plane.

7. In a forming panel for use in construction of a self-sustaining concrete structure from a concrete mix containing flowable constituents which are capable of migrating from a concrete pour during curing of the mix, the improvement comprising:

a segment of the forming panel which defines a forward-facing, concrete-receiving surface located in a position oriented for receiving at least a part of the concrete pour thereagainst during curing of the mix and having a margin in disposition such that said flowable constituents in the concrete pour may migrate past the margin, said segment further defining a second surface adjacent said margin and leading rearwardly away from the concrete-receiving surface; and a flexible barrier element mounted in spaced relationship to said concrete-receiving surface on said second surface in proximal relationship to said margin and operable to impede migration of the constituents out of the pour past the barrier element until the concrete mix has cured, wherein said flexible barrier element includes a plurality of fibers.

8. The forming panel of claim 7, wherein said fibers are bristles.

9. The forming panel of claim 8, wherein said segment of said forming panel is provided on a face plate which is oriented substantially in a plane and said bristles extend along axes which are acutely angled relative to the plane of said face plate when said bristles are uncompressed.

10. The forming panel of claim 9, wherein said forming panel further includes a frame upon which said face plate is mounted and wherein said frame includes a pair of end rails and a pair of side rails spaced-apart by said end rails, said margin being a perimeter margin of said face plate and said rails being coupled to said face plate adjacent the perimeter margin and presenting said second surface, and wherein said bristles are received in slots in said rails.

11. In a forming panel for use in construction of a self-sustaining concrete structure from a concrete mix containing flowable constituents which are capable of migrating from a concrete pour during curing of the mix, the improvement comprising:

a segment of the forming panel which defines a forward-facing, concrete-receiving surface located in a position oriented for receiving at least a part of the concrete pour thereagainst during curing of the mix and having a margin in disposition such that said flowable constituents in the concrete pour may migrate past the margin.

said segment further defining a second surface adjacent said margin and leading rearwardly away from the concrete-receiving surface; and a flexible barrier element mounted in spaced relationship to said concrete-receiving surface on said second surface in proximal relationship to said margin and operable to impede migration of the constituents out of the pour past the barrier element until the concrete mix has cured, wherein said segment includes a face plate having a perimeter and an opening interior to said perimeter, said segment having said margin being located adjacent said opening and said flexible barrier element extending generally toward said opening.

12. The forming panel of claim 11, wherein said flexible barrier element includes a plurality of fibers.

13. The forming panel of claim 12, wherein said fibers are bristles.

14. The forming panel of claim 11, including a support member coupled to said face plate, said second surface being on said support member.

15. The forming panel of claim 14, including a door shiftably mounted on said support member for movement between a first position substantially blocking said opening and a second position.

16. The forming panel of claim 15, wherein said door is pivotally mounted on said support member.

17. The forming panel of claim 15, including a retaining member for holding said door in said first position.

18. The forming panel of claim 17, wherein said retaining member includes a closure element shiftable between a first location wherein said closure element is in engagement with said door when said door is in its first position and a second location permitting shifting of said door between said first position and said second position.

19. The forming panel of claim 18, said retaining member including a spring for biasing the closure element to said first location.

20. The forming panel of claim 19, said closure element including a pin having a nose, a shank and a narrowed neck therebetween, said retaining member including a housing receiving said pin for translational movement relative thereto and receiving said spring therein, said housing further including a catch shiftable between a holding position wherein said catch is received by said neck for holding said pin in said second position and a release position for permitting said spring to bias said pin to said first position.

21. The forming panel of claim 15, wherein said door includes a door-mounted flexible barrier element oriented in opposition to said flexible barrier element mounted on said support element when said door is in said first position.

22. In a forming panel for use in combination with adjacent forming members in the construction of self-sustaining concrete wall structures from a flowable poured concrete mix, said forming panel having a face plate which receives and supports a concrete pour thereagainst and a frame coupled thereto, the improvement comprising:

one of said face plate and frame defining an elongated margin and a forward-facing, concrete-receiving surface which engages the concrete pour therealong during curing, one of said face plate and frame further defining a second surface adjacent said margin and leading rearwardly away from the concrete-receiving surfaces; and an elongated flexible barrier mounted in spaced relationship to said concrete-receiving surface on said second surface proximal to and aligned with said margin and operable to impede flow of the poured concrete mix past the barrier during curing of the concrete, said second surface being on said frame, wherein said margin is a perimeter margin of said face plate and said frame includes at least one elongated rail positioned adjacent said perimeter margin, and wherein said flexible barrier element is elongated and mounted on said rail in longitudinal alignment with the perimeter margin.

23. The forming panel of claim 22, wherein said frame includes a pair of side rails and a pair of end rails, and wherein said flexible barrier element is mounted on each of said side rails and said end rails proximate said perimeter margin.

24. The forming panel of claim 22, wherein said at least one rail includes a face plate edge adjacent said face plate and a back edge relatively remote from said face plate, and said rail further includes an outer surface having at least one relieved area extending between said face plate edge and said back edge and said perimeter margin in said face plate includes at least one recess aligned with said relieved area, said flexible barrier element being mounted on said outer surface to extend across said relieved area.

25. The forming panel of claim 24, wherein said at least one rail includes unrelieved areas adjacent said relieved area and wherein said an outer edge of said flexible barrier in an uncompressed condition is substantially linear along said relieved area and said unrelieved areas.

26. The forming panel of claim 22, wherein said at least one rail includes an elongated slot substantially aligned with and spaced from said margin, and wherein said flexible barrier is received in said slot.

27. The forming panel of claim 26, wherein a portion of said face plate adjacent said margin is substantially in a plane and wherein said slot is oriented at an acute angle relative to said plane.

28. In a forming panel for use in combination with adjacent forming members in the construction of self-sustaining concrete wall structures from a flowable poured concrete mix, said forming panel having a face plate which receives and supports a concrete pour thereagainst and a frame coupled thereto, the improvement comprising:

one of said face plate and frame defining an elongated margin and a forward-facing, concrete-receiving surface which engages the concrete pour therealong during curing, one of said face plate and frame further defining a second surface adjacent said margin and leading rearwardly away from the concrete-receiving surface; and an elonaated flexible barrier mounted in spaced relationship to said concrete-receiving surface on said second surface proximal to and aligned with said margin and operable to impede flow of the poured concrete mix past the barrier during curing of the concrete, wherein said flexible barrier includes a plurality of filaments.

29. The forming panel of claim 28, wherein said filaments are bristles.

30. The forming panel of claim 29, wherein said segment of said forming panel is provided on a face plate which is oriented substantially in a plane and said bristles extend along axes which are acutely angled relative to the plane of said face plate when said bristles are uncompressed.

31. The forming panel of claim 30, wherein said frame includes a pair of end rails and a pair of side rails spaced-apart by said end rails, said margin being a perimeter margin of said face plate and said rails being coupled to said face plate adjacent the perimeter margin and presenting said second surface, and wherein said bristles are received in slots in said rails.

32. In a forming panel for use in combination with adjacent forming members in the construction of self-sustaining concrete wall structures from a flowable poured concrete mix, said forming panel having a face plate which receives and supports a concrete pour thereagainst and a frame coupled thereto, the improvement comprising:

one of said face plate and frame defining an elongated margin and a forward-facing, concrete-receiving surface which engages the concrete pour therealong during curing, one of said face plate and frame further defining a second surface adjacent said margin and leading rearwardly away from the concrete-receiving surface; and an elongated flexible barrier mounted in spaced relationship to said concrete-receiving surface on said second surface proximal to and aligned with said margin and operable to impede flow of the poured concrete mix past the barrier during curing of the concrete, wherein said face plate includes a perimeter and said margin is located along an opening interior to said perimeter, said flexible barrier extending into said opening.

33. The forming panel of claim 32, wherein said flexible barrier includes a plurality of filaments.

34. The forming panel of claim 33, wherein said filaments are bristles.

35. The forming panel of claim 32, said frame including a support member coupled to said face plate, said second surface being on said support member.

36. The forming panel of claim 35, including a door shiftably mounted on said support member for movement between a first position substantially blocking said opening and a second position.

37. The forming panel of claim 36, wherein said door is pivotally mounted on said support member.

38. The forming panel of claim 36, including a retaining member for holding said door in said first position.

39. The forming panel of claim 38, wherein said retaining member includes a closure element shiftable between a first location wherein said closure element is in engagement with said door when said door is in its first position and a second location permitting shifting of said door between said first position and said second position.

40. The forming panel of claim 36, wherein said door includes a door-mounted flexible barrier element oriented in opposition to said flexible barrier element mounted on said support element when said door is in said first position.

41. A forming panel for use in combination with adjacent forming members in the construction of self-sustaining concrete wall structures from a flowable poured concrete mix, said forming panel comprising:

a substantially rigid form member having a forward facing, concrete-receiving first surface configured for receiving and supporting the flowable concrete mix on at least a portion thereof, a second surface leading rearwardly away from said concrete-receiving first surface, and a margin between said first surface and said second surface; and a flexible barrier element mounted in spaced relationship to said concrete-receiving first surface on said second surface proximate said margin for impeding flow of the concrete mix past the flexible barrier during curing of the concrete, said flexible barrier being mounted for extending from said second surface, wherein said flexible barrier includes a plurality of filaments.

42. A forming panel for use in combination with adjacent forming members in the construction of self-sustaining concrete wall structures from a flowable poured concrete mix, said forming panel comprising:

a substantially rigid form member having a forward facing, concrete-receiving first surface configured for receiving and supporting the flowable concrete mix on at least a portion thereof, a second surface leading rearwardly away from said concrete-receiving first surface, and a margin between said first surface and said second surface; and a flexible barrier element mounted in spaced relationship to said concrete-receiving first surface on said second surface proximate said margin for impeding flow of the concrete mix east the flexible barrier during curing of the concrete, wherein said form member includes a face plate and a frame member mounted to said face plate, said first surface being provided on said face plate and said second surface being provided on said frame member, said frame member mounting said flexible barrier in a longitudinally extending slot substantially aligned with and spaced closely adjacent said margin.

43. A forming panel as set forth in claim 44, said margin being a perimeter margin on said face plate and including a plurality of elongated frame members extending in substantial alignment with said margin, each of said elongated frame members mounting a flexible barrier element thereon.

44. A forming panel as set forth in claim 43, including a slot in each of said frame members and receiving a flexible barrier element therein, said slot being oriented at an acute angle relative to a plane in which said face plate is positioned.

45. The forming panel of claim 44, wherein at least one of said frame members includes a face plate edge adjacent said face plate and a back edge relatively remote from said face plate, and said frame member further includes an outer surface having at least one relieved area extending between said face plate edge and said back edge and said perimeter margin in said face plate includes at least one recess aligned with said relieved area, said flexible barrier being mounted on said outer surface to extend across said relieved area.

46. The forming panel of claim 45, wherein said at least one frame member includes unrelieved areas adjacent said relieved area and wherein said an outer edge of said flexible barrier in an uncompressed condition is substantially linear along said relieved area and said unrelieved areas.

47. A forming wall system for receiving a pour of concrete thereagainst comprising:

a first forming panel presenting a margin and having a face plate with a forward facing, concrete-receiving surface configured for receiving concrete thereagainst and a frame mounted on said face plate in supporting relationship, said first forming panel having a second surface proximate said margin and leading rearwardly away from said concrete-receiving surface;

a second forming panel presenting a margin and having a face plate with a forward facing, concrete-receiving surface configured for receiving concrete thereagainst and a frame mounted on said face plate in supporting relationship, said second forming panel having a second surface proximate said margin and leading rearwardly away from said concrete-receiving surface;

a coupler mounting said first forming panel adjacent to said second forming panel whereby a gap is presented between the first forming panel and said second forming panel; and a flexible barrier element mounted in spaced relationship to said concrete-receiving surface on at least one of said second surfaces of the forming panels and positioned proximal to and extending along at least a portion of the margin of said first forming panel and into the gap for impeding concrete constituents from migrating past said barrier during curing of said concrete.

48. The forming wall system of claim 47, wherein said first and second forming panels are disposed in side-by-side relationship.

49. The forming wall system of claim 47, wherein said second surface is on said frame of said first forming panel.

50. The forming wall system of claim 49, wherein said frame includes an elongated rail having a longitudinally extending slot aligned with said margin, and wherein said flexible barrier element is mounted in said slot.

51. The forming wall system of claim 50, wherein the face plate of said forming panel lies in a plane and said slot is oriented along an axis which is at an acute angle relative to said plane.

52. The forming wall system of claim 50, wherein said rail has an outer surface which includes a relieved area having a lesser thickness than portions of the rail adjacent thereto, and wherein said slot and said barrier element extend across said relieved area.

53. The forming wall system of claim 52, including a tie element received in said gap at said recessed area and coupled to at least one of said first and second forming panels, and wherein said barrier element engages said tie element.

54. The forming wall system of claim 53, including a third forming panel and a fourth forming panel positioned opposite and spaced from said first forming panel and said second forming panel, respectively, to provide a concrete-receiving channel therebetween, and including a coupler connecting said third forming panel, said fourth forming panel and said tie element.

55. The forming wall system of claim 47, wherein said frame of said first panel includes a pair of side rails and a pair of end rails connected to said face plate, each of said side rails and end rails having said second surface thereon and including a slot extending parallel to and positioned proximate to said face plate and receiving said flexible barrier element therein.

56. The forming panel of claim 39, said retaining member including a spring for biasing the closure element to said first location.

57. The forming panel of claim 38, said closure element including a pin having a nose, a shank and a narrowed neck therebetween, said retaining member including a housing receiving said pin for translational movement relative thereto and receiving said spring therein, said housing further including a catch shiftable between a holding position wherein said catch is received by said neck for holding said pin in said second position and a release position for permitting said spring to bias said pin to said first position.

* * * * *

UNITED STATES PATENT AND TRADEMARK OFFICE

CERTIFICATE OF CORRECTION

PATENT NO. : 6,655,650 B2
DATED : December 2, 2003
INVENTOR(S) : Ward, Philip T.

It is certified that error appears in the above-identified patent and that said Letters Patent is hereby corrected as shown below:

Column 10,
Line 38, replace the word “elonaated” with the word --elongated. --.

Column 12,
Line 6, replace the word “east” with the word -- past --.
Line 14, replace the number “44” with the number -- 42 --.

Signed and Sealed this

Eighteenth Day of October, 2005

JON W. DUDAS
*Director of the United States Patent and Trademark Office*